US006668713B2

(12) United States Patent
Vomberg

(10) Patent No.: US 6,668,713 B2
(45) Date of Patent: Dec. 30, 2003

(54) PLATEN PRESS WITH PERIPHERAL SEAL

(75) Inventor: Rainer Vomberg, Wegberg (DE)

(73) Assignee: Siempelkamp Maschinen- und Anlagenbau GmbH & Co. KG, Krefeld (DE)

( * ) Notice: Subject to any disclaimer, the term of this patent is extended or adjusted under 35 U.S.C. 154(b) by 0 days.

(21) Appl. No.: 10/195,860

(22) Filed: Jul. 15, 2002

(65) Prior Publication Data

US 2003/0024417 A1 Feb. 6, 2003

(30) Foreign Application Priority Data

Jul. 18, 2001 (DE) ..... 101 35 055

(51) Int. Cl.[7] ..... B30B 7/02; B30B 1/00

(52) U.S. Cl. ..... 100/195; 100/214; 100/325; 156/228

(58) Field of Search ..... 100/193, 194, 100/195, 199, 73, 214, 325, 326; 156/228, 563, 87, 285; 264/113, 109; 425/419, 420, 406

(56) References Cited

U.S. PATENT DOCUMENTS

| | | | | |
|---|---|---|---|---|
| 3,619,450 A | * | 11/1971 | Futo | 264/109 |
| 4,154,272 A | * | 5/1979 | Huffman, Jr. | 100/195 |
| 4,162,877 A | * | 7/1979 | Nyberg | 425/84 |
| 4,409,170 A | | 10/1983 | Stofko | |
| 4,850,849 A | * | 7/1989 | Hsu | 425/407 |
| 4,854,994 A | * | 8/1989 | Breiter et al. | 156/228 |
| 5,158,012 A | * | 10/1992 | Gawlitta et al. | 100/38 |
| 6,132,656 A | * | 10/2000 | Dodd | 264/83 |
| 2003/0051797 A1 | * | 3/2003 | Lines et al. | 156/209 |

* cited by examiner

*Primary Examiner*—Allen Ostrager
*Assistant Examiner*—Jimmy T Nguyen
(74) *Attorney, Agent, or Firm*—Herbert Dubno

(57) ABSTRACT

A platen press, especially a multiplaten press has peripheral seals around the press platens to seal off the pressing gaps containing the wood material mats to be pressed on suction passages formed between the platens and communicating suction ducts at the upper or lower sides of the press, whereby fibers are evolved from the mats and are drawn off through these passages and conduits without significant dilution with ambient air or air serving to cool the platens for destruction by combustion.

24 Claims, 8 Drawing Sheets

13
12
25
16b
16a
14
15
11
4
20
16
16b
W
6
19
5
5
1
2
17
18
2

PLATEN PRESS WITH PERIPHERAL SEAL

FIELD OF THE INVENTION

My present invention relates to a platen press and, more particularly, to a multiplaten press for the production of boards from wood materials.

BACKGROUND OF THE INVENTION

Platen presses and especially multiplaten presses are used for the pressing of mats of materials containing wood inch boards. Such materials can include wood fibers and wood particles or sawdust, with or without binders, usually synthetic resin binders, which may or may not be heat-activatable and where the platens are usually arrayed one above the other to form press gaps.

The platen press systems with which the invention is primarily concerned are those which provide the press with a suction unit for drawing off by suction gases produced during the pressing of the boards. The press platens in this case are heated platens and the boards which are produced are particle board, OSB (oriented strand board) or MDS (medium densified fiber) board.

The mats of the wood material to be pressed are usually fed to the press gaps between the platens on charging plates or trays, charging screens or sieves or like supports or are supplied to the press by belt feeders. The press can then be closed and the mats pressed to boards within the press gap. During the hot pressing process, steam and gases can be evolved which, without the suction unit, would be released into the atmosphere and might be an environmental contaminant. In the processes with which the invention is concerned, the evolved gasses and steam are drawn off by the suction unit and can be trapped in a gas cleaner without being released into the atmosphere. Those gases may include gases evolved by any binder which may be combined with the wood chips, particles or fibers as well as those evolved by the wood materials themselves.

The platen press is usually preceded by a charging device for supplying the mats to the platens and by an emptying or charging device which removes the boards from the press. Units for drawing off the fumes by suction have, in the past, included relatively large hoods or enclosures which generally encompass at least the press and the press-emptying apparatus. As a consequence large screen blowers were required to handle the comparatively large volumes of gas (evolved vapors and ambient air) which were required. For example, the suction unit frequently was required to draw off not only the evolved fibers but also cooling air which had to be supplied to the press.

The drawn off gases required processing, for example with after-burners or the like to destroy the drawn-off vapors. Frequently the proportion of combustibles in the drawn off gas was insufficient to permit effective destruction of the vapors and it was necessary to add fuel to the system to ensure destruction of the evolved vapors. The operation was, therefore, expensive and the equipment evolved had to be sizable.

Multiplaten presses have been provided heretofore with spacers or spacer frames between the platens and wherein heat-resistant seals could be provided between the platens. The platens were provided with gaps running in the longitudinal direction of the platens and which were connected by transverse passages so that the press gaps themselves were interconnected. In such a system the evolved gas could be collected by a pipe system in a tank. The pipe system could use flexible lengths of pipe which could be provided on opposite sides of the platen as, for example, in U.S. Pat. No. 4,409,170. The systems described in this patent are also expensive and in many cases there is insufficient room alongside the press platen to provide the duct work such systems require.

OBJECTS OF THE INVENTION

It is, therefore, the principal object of the present invention to provide an improved platen press, especially a multiplaten press, which is not only of simpler construction than those provided heretofore and can be operated reliably and economically to evacuate evolved gases and steam, but which is also of simpler construction and space-saving design.

More specifically, it is an object of the present invention to provide a platen press with improved and evacuation of vapor from the press gap. Another object of this invention is to provide a platen press which obviates drawbacks of earlier systems.

SUMMARY OF THE INVENTION

These objects and others which will become apparent hereinafter are attained, in accordance with the invention, in a platen press for the pressing of mats of wood material into pressed board which comprises:

- a plurality of platens disposed one above another between upper and lower press sides and defining press gaps between then for receiving wood-containing mats and pressing the mats to form boards;
- seals between the platens around the gaps for sealing the gaps upon closing of the press;
- passages formed in the platens and communicating with one another and with the gaps inwardly of the seals for forming at least one evacuating duct; and
- at least one suction conduit on one of the sides of the press and communicating with the duct at least in a closed position of the press for evacuating gases evolved from the mats during pressing thereof.

According to the invention, therefore, a plurality of platens arranged one above another in the multiplaten press define press gaps between them, each of which is adapted to receive a mat of wooden material so that when the press is closed and the material is compressed between the heated platen, vapors are evolved which are drawn off by a suction unit.

According to the invention, seals are arranged around the periphery of the press platens around the press gaps and seal these gaps upon closure of the press. Each of the press platens can have one or more passages which, upon closure of the press, form evacuation ducts communicating with the press gaps and the upper side of the press and/or the lower side of the press for one or more conduits which communicate with the evacuation ducts.

As a consequence, a direct evacuation of the released vapors is possible since the press gaps themselves are peripherally sealed and the suction conduit on one of the upper or lower sides of the press can directly evacuate the communicating press gaps through passages formed in the platens.

As a consequence it is no longer necessary to evacuate ambient or cooling air with the evolved vapors and in large volumes. Rather the evolved vapors can be sucked off and efficiently burned so that the platen press according to the invention can operate completely in an environmentally sound manner.

Because the external duct work along the sides of the platens is not required, the construction of the press is simplified and the press can take up less space.

The conduits, according to the invention, communicate with the passages at the ends of the platens and press via communicating passages formed in the platens within the seals. The conduits in the upper and/or lower sides of the press ensure that the press will be laterally free from conduits and either rigid or flexible duct work and thus achieve an economy of construction and space which has not been possible heretofore. The conduits, usually a bundle of conduits connected together and to a common suction blower, can be provided at each end of the press in one or the other of the fixed press plates, e.g. the upper press plates so that there is no relative movement between the conduits or between the conduit and the upper and lower press plates or beds.

The passages formed in the platens can be vertical and aligned so that they form continuous evacuating ducts running the full height of the stack of platens. These passages can be flush with one another.

The invention is applicable not only to multiplaten presses but also to single platen presses having an upper and lower press plate or bed. Only a passage in one or the other of these beds is then required to communicate with the evacuating duct formed by a passage at an end of the platen within the seal and communicating with the press gap.

While it is preferred to provide the conduit exclusively in the upper press platen, it has been found to be advantageous to provide conduits in both the upper and lower press plate for connection to respective suction blowers.

Advantageously, an array of passages are formed in equispaced relationship at each end of the press and in the press platen for communication with corresponding numbers of conduits. In that case, in the middle of the press or along the longitudinal edges of the platens between those arrays of passages, there are neither passages nor evacuation conduits. In this case, the dimensions, at least in their widths of the platens by comparison with the platens of prior art presses, need not be increased. The provision of multiple evacuation conduits and passages at each end also affords the advantage that steam can be drawn off in large quantities. This is especially desirable for the production of OSB boards since there the steam predominantly emerges from the mats at the board ends. Only toward the end of a press operation is there an increase in lateral steam evolution.

It has been found to be advantageous to provide the evacuating ducts so that they are equidistantly spaced across the width of the press platens so that a uniform evacuation of the vapors and gases which are released can be ensured. The evacuating ducts can be formed by boards in the platens which are aligned and flush with one another, the boards forming the aforementioned passages.

The suction conduits, in turn, are aligned with and flush with the passages on the lower side of the upper press bed or uppermost press plate or on the underside of the lower press plate or press bed. There the suction conduits communicate with the passages on the upper side of the uppermost platen or the lower side of the lowermost platen, respectively.

To the extent that a multiplicity of suction conduits are provided on each end of the press, they may be joined in suction conduit bundles, each of which communicate with one or more blower devices. When there is a single suction conduit bundle at each end, each bundle may communicate with a respective intake side of a blower.

According to a further feature of the invention in the suction conduit and/or the suction passages, valve elements, for example, flat valves, may be provided. The evolved gases may remain in the suction passages while these valves are closed during an initial press stage and only upon opening of the valve during a subsequent press stage are drawn off by suction. This permits a higher valve pressure to be maintained at least during the initial press stages which has been found to be advantageous for the pressing process and the property of the boards produced. The valve flaps can be opened during the concluding stages of pressing.

It has been found to be advantageous moreover to provide the apparatus with a steam generator unit for feeding steam into the press gaps during, before and/after the pressing process. The term "steam" means water vapor and preferably saturated steam. Basically, however, other gaseous fluid media can be fed into the system. For this purpose, steam supply conduits are provided which can communicate with the suction conduits and thus directly or indirectly with the passages formed by the aligned boards in platens. The steam is thus distributed to the press gap via the vapor evacuation system. The steam can positively influence the pressing process by, for example, reducing the press time and can be an important advantage with respect to board quality since it can prevent excess moisture loss at the edges of the boards and assist in rendering the board temperature more uniform during press operation. The result is a significant increase in press board quality.

The suction ducts thus have a dual function and the suction conduits can be provided with valve members such as flaps to enable the steam supply ducts to be shut off or connected to the press gaps. It is, however, also possible to provide separate steam supply ducts which can communicate with passages in the platen and on the upper press bed or lower press bed and which can communicate with the press platens through separate boards in the uppermost and lowermost platens.

Especially advantageous is an embodiment in which the steam supply ducts and the suction conduits communicate with one another and each has a valve flap for blocking flow therethrough so that in one position of the valve, flow of steam to the gaps is provided and in another, the gaps can be evacuated.

The press gaps when charged with steam must permit the steam to be distributed uniformly in the gap so as to ensure a uniform temperature distribution. The supply-saturated steam forms a steam lock which allows heating to temperatures of up to 160° C. and usually about 140° C. so that excessive temperature losses at the edges of the board will not occur. To prevent stressing or damaging the seals, the valve members can be provided as safety valves or pressure relief valves which can prevent excessive pressure buildup although it is also possible to provide in parallel with each of the aforementioned valves a pressure-limiting or pressure-relief valve.

The press of the invention is usually used in the production of boards of wood material of a thickness of about 6 mm to about 41 mm. The seals thus should be capable of compensating for this variation in the pressing gap width. This can be achieved according to the invention by providing the seals as an inflatable or expandable bladder and expanding the seals with a gas, for example, compressed air. The seals are then hollow and expandable. Depending upon the board thickness, the seals can be inflated or expanded to a predetermined degree with compressed air so that the sealing action is ensured regardless of the board thickness.

According to the invention, the seals can have base bodies enabling their attachment to the respective press platen and to which the expandable sealing body is connected. The sealing body can be of circular cross section, oval cross section or polygonal cross section. The seal itself is preferably composed of a heat-resistant material, especially a synthetic resin, like silicone or a fluoroelastomer which can withstand temperatures of 220° C. to 250° C. which can be reached in the press.

To facilitate attachment of the seal to the platen, it has been found to be advantageous to provide the platen with a mounting recess in which the base body is received and can be affixed by screws, rivets or by an adhesive.

The seal preferably engages the platen through the intermediary of one or more thermal insulating elements, for example, insulating bodies or layers, especially strip-shaped insulators. Such insulation prevents excessive heating of the seal by the heated platen and allows high temperature to be produced in the press without problems or endangering of the seal. The insulating elements can be composed, for example, of a silicone or a ceramic.

The seals can be provided directly or indirectly on the press platens or heating platens whereby they can engage the neighboring platens directly or indirectly or also can bear upon charging plates or charging sieves or screens on which the mats are fed into the press, especially when a structure is to be formed on the plate and is to be transferred from the charging plate to the board. The edge portions of these charging plates or screws can be provided with an insulating strip which are designed to protect the seals and thereby increase the seal life and the sealing effect. The edge covering of such screens or plates may be composed of silicone or may be silicone impregnated layers.

In embodiments in which the seals, upon closure of the press, do not rest against a charging plate or charging screen with corresponding edge coverings, it is advantageous for the seals to be juxtaposed with press platen surfaces whose edge regions are provided with insulating elements in the form of insulating strips or layers against which the seal can bear. Such an embodiment in which the insulating element is received in a mounting recess in the press platen and is composed of a heat-resistant synthetic resin such as a silicon or ceramic can improve the press efficiency. The heat-resistant or insulating element can be held in place by screws, rivets or adhesive bonding. In a preferred embodiment, however, the insulating element is held in place by means of one or more clamps which can be C-shaped, U-shaped or L-shaped and can secure the attached member in a recess, if desired.

The insulating elements or strips can be of trapezoidal cross section and received in a trapezoidal section or partially trapezoidal mounting press. Finally, the evacuation conduit and/or the steam supply conduit can be formed as insulated ducts with an insulating jacket or an insulating layer to avoid thermal losses. The ducts and conduits can also be externally heated.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
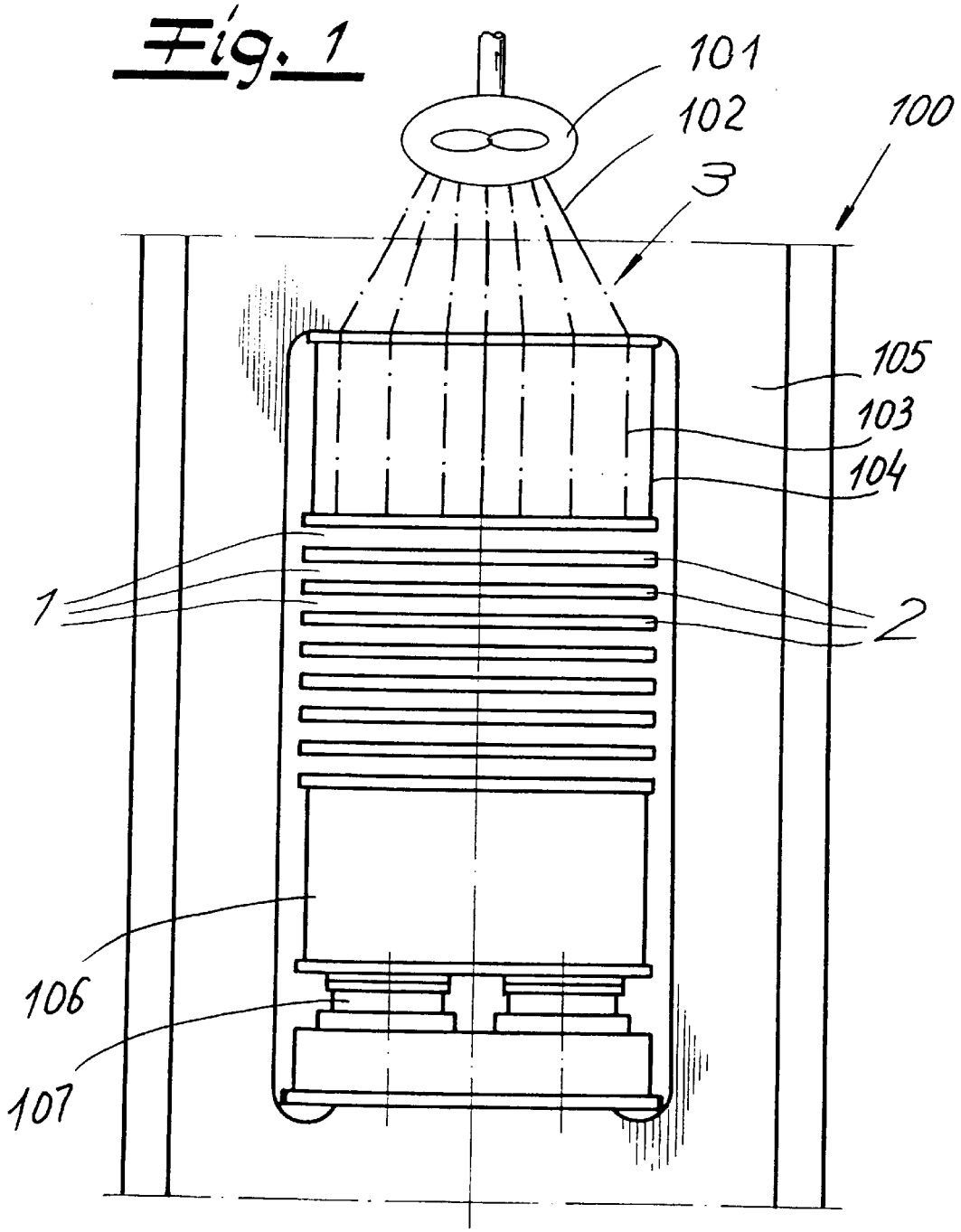
FIG. 1 is a diagrammatic view of a multiplaten press illustrating the invention.

The multiplaten press 100 can be used for the production of boards from wooden materials, for example, oriented strand board (OSB) unit on a multiplicity of press platens 2 which can be heated and which define between them press gaps 1, shown only diagrammatically in FIG. 1. To evacuate the fibers produced in the course of the press process, an evacuating system represented generally at 3 is provided. This system can include a suction blower 101 connected at 102 to a bundle of suction conduits 103 formed in the head 104 of the press. The head 104 can be a fixed press plate mounted in the frames 105, only one of which is visible in FIG. 1 but a number of which can be seen in FIG. 4. The blower 101 is shown spaced from the head plate 104 of the plates and is analogous to the blower 10 shown in FIG. 2 for a bundle of suction conduits at one end of the press.

A bed plate or bed 106 is provided at the bottom of the press and can be raised by hydraulic cylinders 107 braced against the frames 105 and the press can also include a closure device for removing the platens into their closed position as the bed 106 rises.

Between the press platens 2 defining the gaps 1, peripheral seals 4 can be provided to close the gaps 1 against the exterior and thus to seal these gaps in the closed positions of the press platens. The press platens are provided with bores 5 which, in the closed position of the platens are aligned with one another and, indeed register with one another and can be flush with one another to form evacuating ducts from the aligned passages of the several plates which communicate with the press gaps 1. The evacuating ducts 6 communicate with the suction conduits 7, here provided in the head plate 104 of the press to enable the evolved vapors to be withdrawn as represented by the arrows shown in FIGS. 2 and 4.

Figure 4:
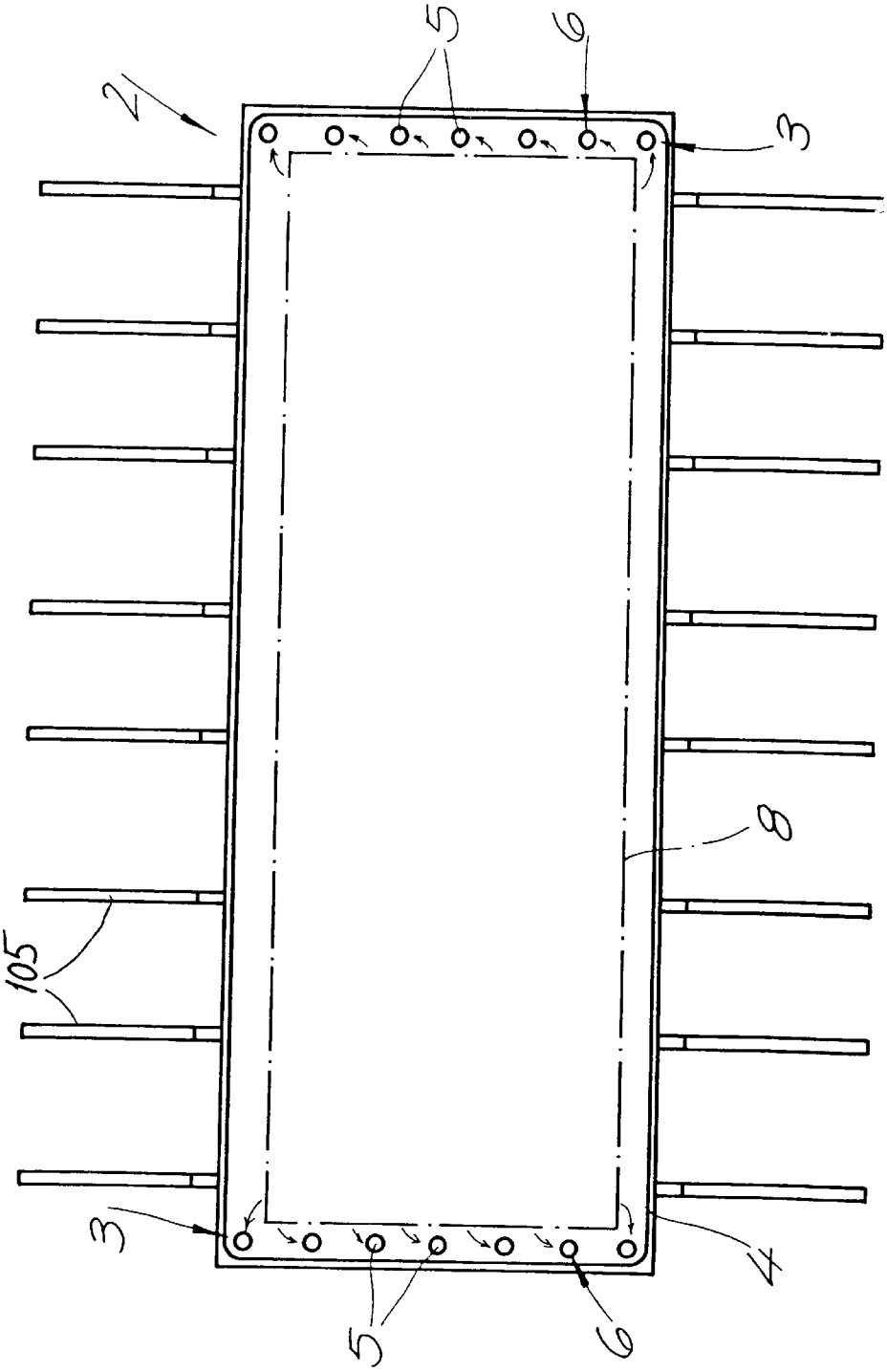
FIG. 4 is a plan view of a press platen for the press of FIGS. 1–3.

The passages 6 and thus the bores 5 run vertically and perpendicular to the platen surfaces and are provided in the end regions of the platens as can be seen in FIG. 4. The passages have predetermined uniform spacings from one another at each end of the press and lie outside of the perimeter of the mat which is to be pressed into the board and has been shown by the dot-dash line 8 in FIG. 4. The flow of the evolved gases into the passages 6 has been represented by arrows in FIG. 4 as well.

Figure 2:
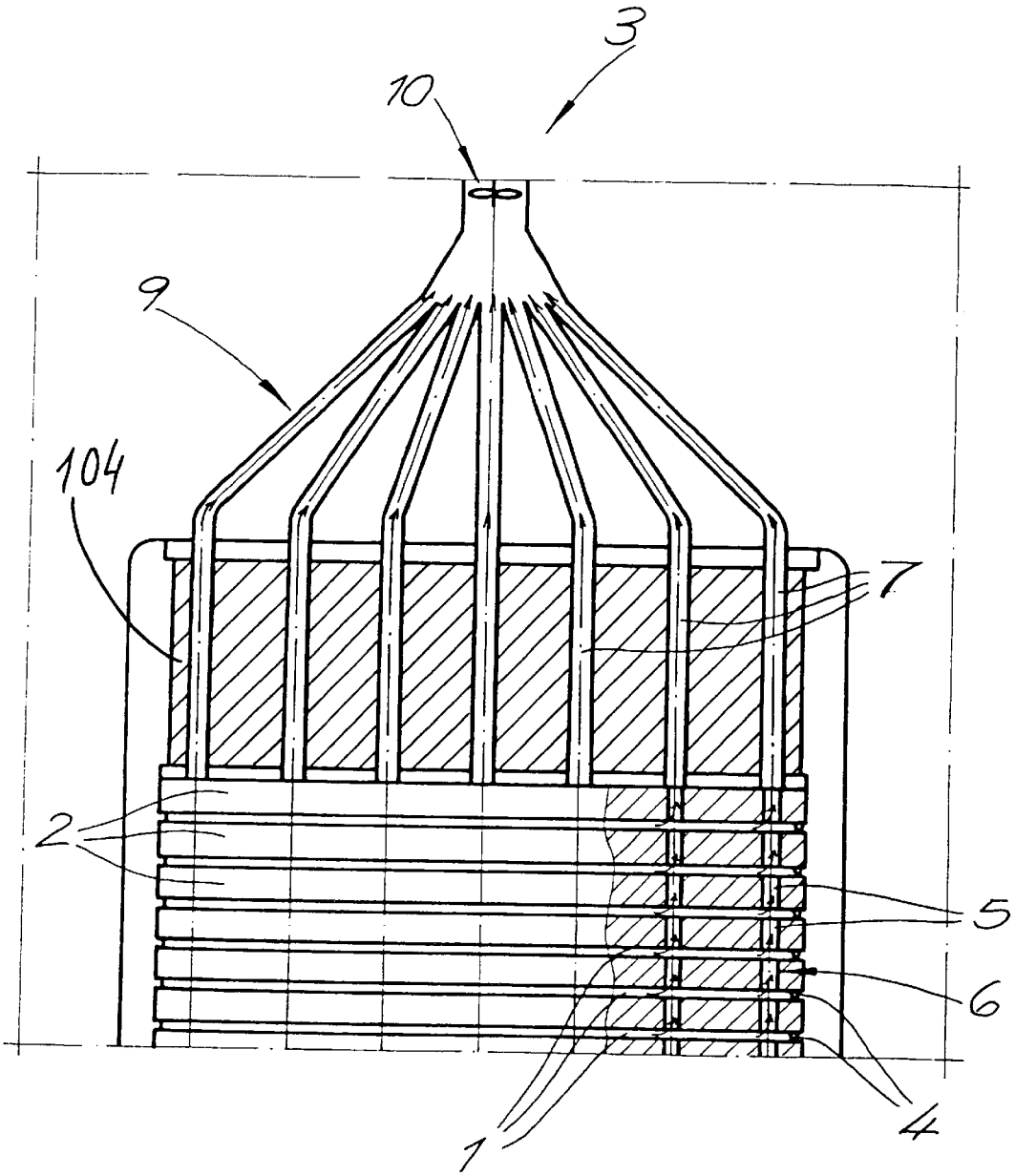
FIG. 2 is a fragmentary section of the end of the press of FIG. 1.

From FIG. 2 it will be apparent that the conduits 7 register and are flush with the passages 6 at the upper side of the uppermost press platen 2. At each end of the press platen stack is a respective bundle 9 of the conduits 7 and each bundle communicates with a respective suction blower 10. The suction blowers deliver the vapors to an after-burner (not shown).

Figure 3:
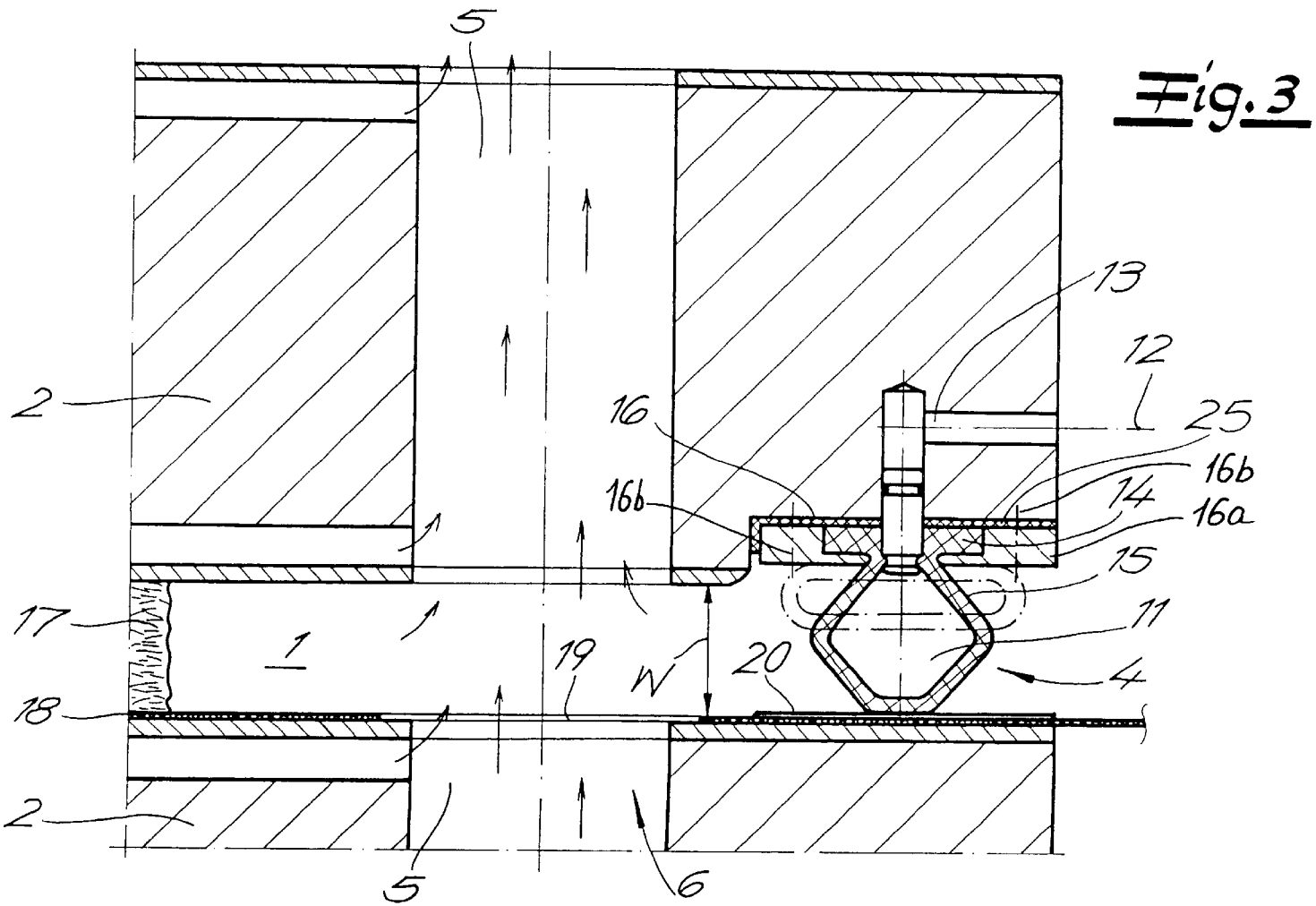
FIG. 3 is a detail section of a portion of the press seen in FIG. 2.

FIG. 3 shows that the seals 4 can accommodate different press gap widths W or board thicknesses. The seal 4 in the embodiment shown in FIG. 3 is an inflatable seal with a hollow interior 11 which can be supplied with compressed air through the compressed air passage 13 from a compressed air supply line 12. The extended state of the seal 4 is shown in solid lines in FIG. 3 and the contracted state is shown in dot-dash lines. As will be apparent from FIG. 3, moreover, the seal 4 may comprise a base body 14 of plate-like shapes which is held by the clamping plate 16*a* and screws shown only diagrammatically at 16*b* in a recess 16 of a platen 2. In the noninflated position of the seal it has an oval cross section and when expanded, it has a generally trapezoidal shape.

The sealing body 15 and its base 14 my be composed of a heat-resistant synthetic resin like a fluoroelastomer so that it an resist temperatures of 250° C. or greater. Furthermore, it can be seen from FIG. 3 that the seal is separated from the platen 2 by a heat-insulating strip 25.

In FIG. 3, the mat is shown at 17 at the left side of the Figure and has been introduced into the gap 1 on a charging section 18 which is formed with openings 19 aligned with the passage 6. To prevent damage of the seal 4 where it engages the charging plate 18, the screen is covered by a layer 20 which may be a silicone or a silicone-impregnated layer and also functions as a thermal insulator.

Figure 8:
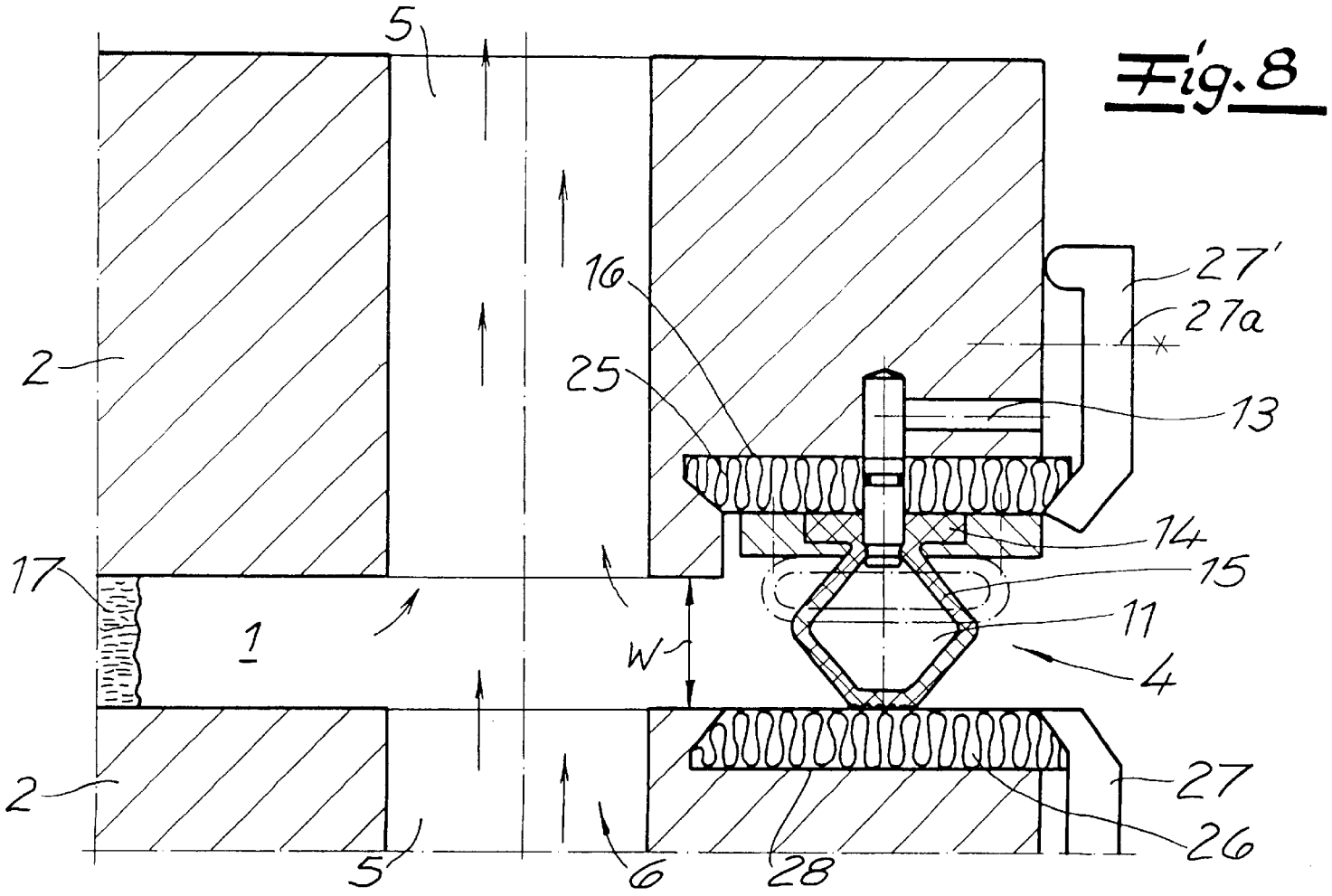
FIG. 8 is a view similar to FIG. 3 of an alternative embodiment.

FIG. 8 shows an embodiment in which the mat 17 is assumed to have been laid into the gap 1 of a respective platen 2 by a charging belt or the like which can extend into the press between the platens and, upon withdrawal, deposits the mat in place. In this embodiment the seal against the lower press platen is provided between the sealing member 4 as previously described and an insulating strip 26 which can have a trapezoidal cross section and can be received in a recess 28 of the under-lying platen 2. The insulating strip 26 and an insulating strip 25 between the base 14 of the sealing body 15 and the upper platen can be held in place by clamping members 27 and 27' which are of U shape or C shape and are secured by screws as diagrammatically represented at 27*a* in FIG. 8. The clamping members 27 and 27' each have shanks which reach over the respective thermal insulating strip 25, 26 and secure it in place in the respective recess.

Figure 5:
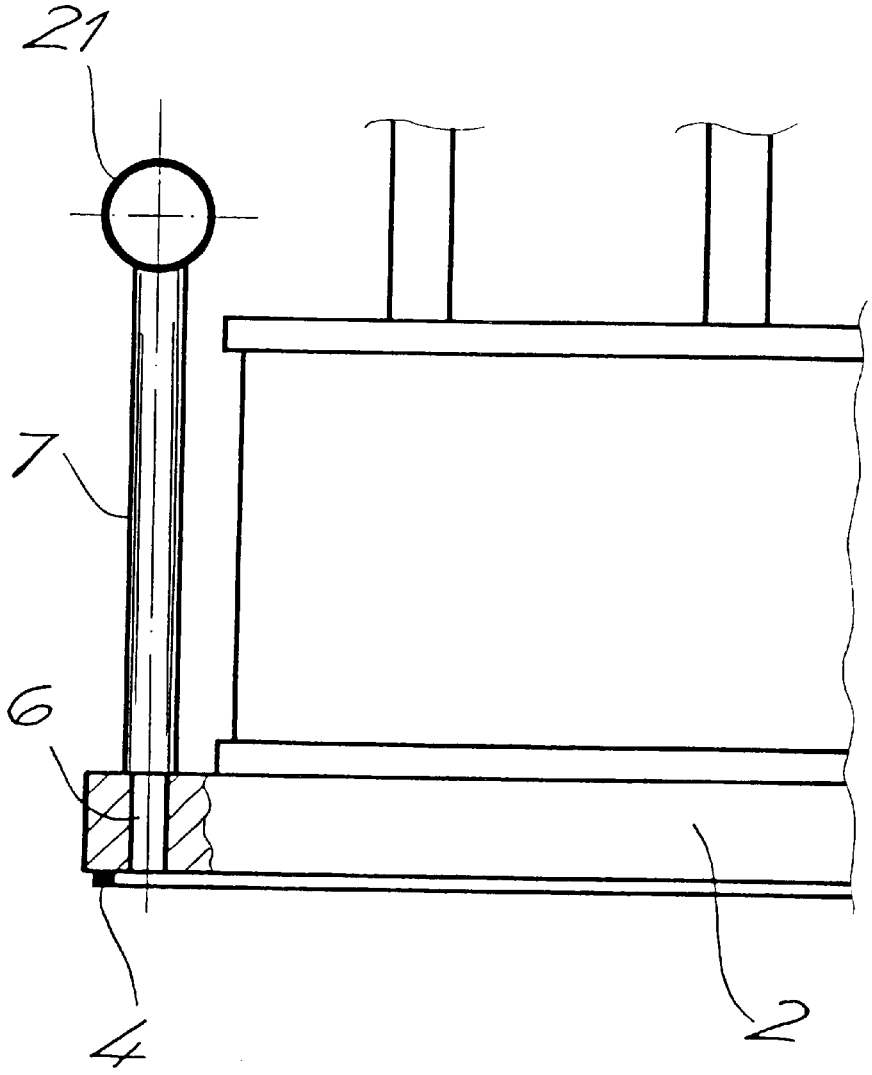
FIG. 5 is a detail of a modified press arrangement.
Figure 6:
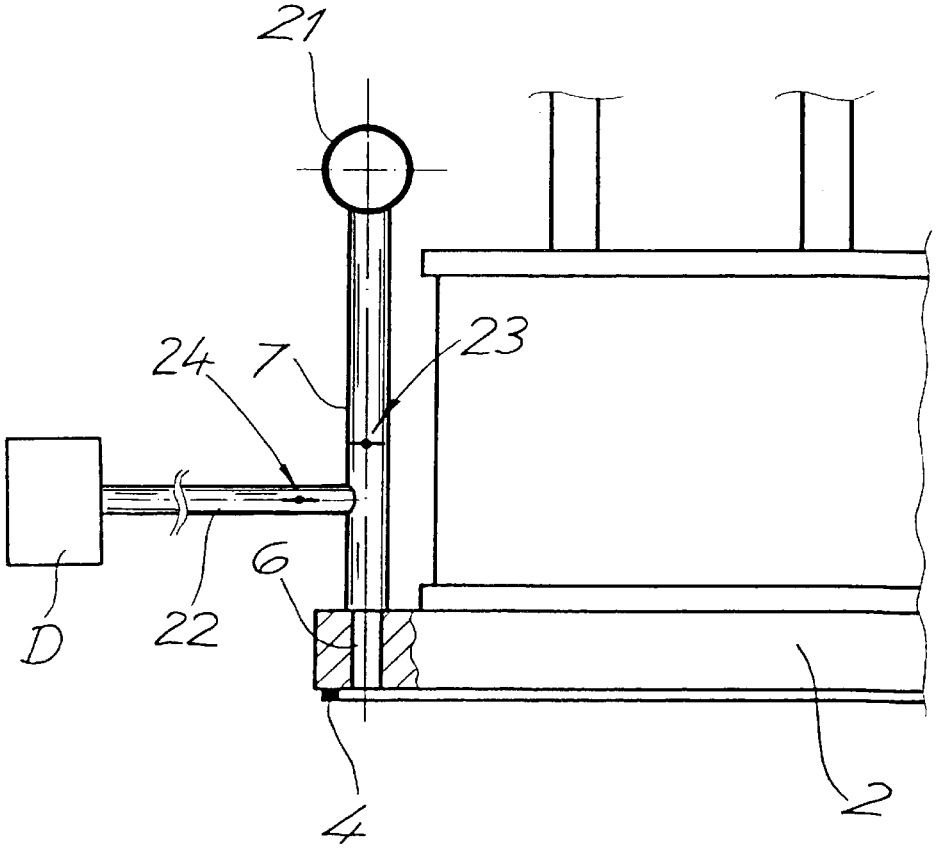
FIG. 6 is a view similar to FIG. 5 of another modification.

FIGS. 5 and 6 show alternatives to the system of FIG. 2 and in views which are rotated with respect to that of FIG. 2 through 90°. In the left portion of each of the Figures, the suction passage 6 is shown and can be seen to communicate with a conduit 7 connected by a manifold 21 to a respective suction source, e.g. suction blower 101 diagrammatically represented in FIG. 1. The manifold 21 is orthogonal to the conduits and thus can run substantially horizontally.

As can be seen from FIG. 6, valve members in the form of flaps 23 can be provided in the conduit 7 to shut off the suction flow. In this system, a steam generator is connected by a pipe 22 to the conduit 7 between the valve 23 and the respective passage 6. A similar butterfly or flap valve 24 can be provided in the steam conduit 22. As a consequence with the valves 23, steam can be supplied via lines 22 through the conduits 7 to the passages 6 and the pressing gaps 1 inwardly of the seals 4. Conversely when the flaps 24 are closed and flaps 23 are opened, suction can be applied through the conduits 7 to the passages 6 to draw off the steam and vapor which may be released from the compressed material.

Figure 7:
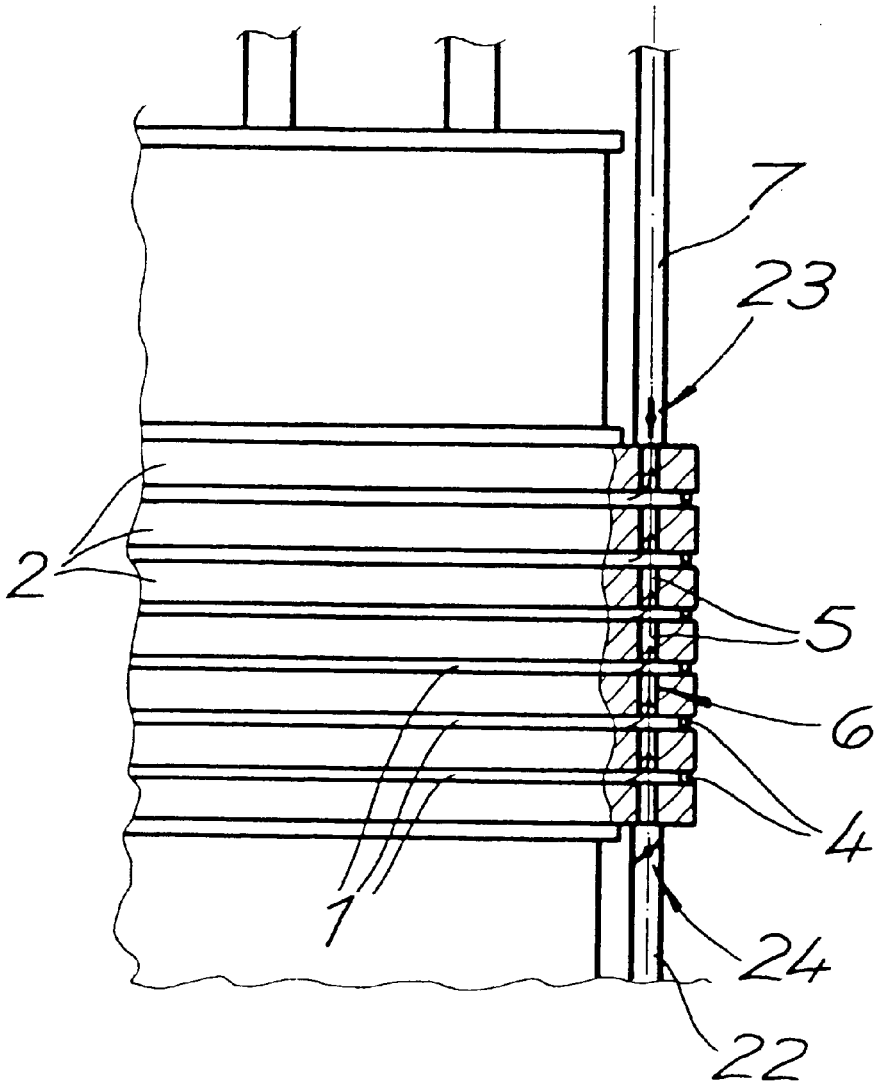
FIG. 7 is a fragmentary elevational view, partly broken away through press of FIG. 2 with the view rotated through 90° relative to the view of FIG. 2.

FIG. 7 shows an embodiment in which the bores 5 are aligned to form a passage 6 communicating with the respective suction conduit 7 which lies outside the head of the press. In this embodiment, the steam is supplied by a conduit 22 to the passage 6 from below and valves 23 and 24 are provided in the conduits 7 and 22 to allow evacuation or treatment of the pressed product with the steam selectively.

The steam supply, of course, can be shut off while evacuation is effected. The arrangement shown in FIG. 7 has the advantage that the condensate can drain back through the conduit 22 and will not accumulate in the press gaps.

I claim:

1. A platen press comprising:

a press head at an upper side of the press and a press bed at a lower side of said press, one of said press head and said press bed being fixed;

a plurality of platens disposed one above another between said upper and lower press sides and defining press gaps between them for receiving wood-containing mats and pressing said mats to form boards;

seals between said platens all around peripheries of said platens and said gaps for sealing said gaps upon closing of the press;

passages formed in said platens and communicating with one another and with said gaps inwardly of said seals for forming at least one upright evacuating duct; and at least one suction conduit on one of said sides of said press and communicating with said duct at least in a closed position of said press and through a passage for said passage in a respective one of said platens proximal to said one of said sides for evacuating gases evolved from said mats during pressing thereof.

2. The platen press defined in claim 1 wherein said passages are perpendicular to said platens and are aligned with one another in a vertical direction.

3. The platen press defined in claim 2 wherein a plurality of said passages are provided at each end of a respective platen and have a predetermined spacing from one another.

4. The platen press defined in claim 3 wherein a multiplicity of said passages are provided at each end of each platen and are equispaced across the width thereof.

5. The platen press defined in claim 4 wherein said passages are bores formed through the respective platens.

6. The platen press defined in claim 1 wherein said suction conduit is aligned with the passage of one of said platens adjoining said one of said sides of the press.

7. The platen press defined in claim 1 wherein said suction conduit is one of a multiplicity of suction conduits at least at one end of the press and communicating with respective ducts equispaced across the widths of the platens, said multiplicity of conduits being joined together for evacuation by at least one suction blower.

8. The platen press defined in claim 1 wherein a respective said multiplicity of conduits is provided at each of said sides of the press to communicate with respective ducts equispaced across the widths of platens at each end thereof with the conduits of each multiplicity being joined together to form an evacuatable bundle.

9. The platen press defined in claim 1, further comprising at least one valve member in said suction conduit or said duct for blocking flow of air therethrough.

10. The platen press defined in claim 1, further comprising a steam supply device for supplying steam to said press gaps prior to, during or subsequent to pressing.

11. The platen press defined in claim 10, further comprising a multiplicity of steam-supply passages communicating with each press gap for delivering the steam thereto.

12. The platen press defined in claim 10, further comprising a steam-supply line communicating with a respective one of said passages at an uppermost side of an upper one of said platens or a lowermost side of a lower one of said platens.

13. The platen press defined in claim 12, further comprising a valve member in said line for blocking said line.

14. The platen press defined in claim 1 wherein said seals are of variable width to match different press gap widths and board thicknesses.

15. The platen press defined in claim 14 wherein said seals are fluid expandable seals provided with pressurizable spaces communicating sources of pressure fluid.

16. The platen press defined in claim 15 wherein each seal comprises a base enabling the attachment of the seal to the respective press platen and an expandable sealing body connected to the respective base.

17. The platen press defined in claim 16 wherein said sealing bodies are of circular, oval or polygonal cross section.

18. The platen press defined in claim 17 wherein said seals are composed of heat-resistant synthetic resin.

19. The platen press defined in claim 18 wherein said synthetic resin material is a silicone or fluoroelastomer.

20. The platen press defined in claim 16 wherein each platen is formed with a recess for receiving the respective base.

21. The platen press defined in claim 1, further comprising at least one thermal insulator disposed between each seal and a platen against which the respective seal can bear.

22. The platen press defined in claim 1 wherein said mats are provided in said press on charging screens which are provided with screen covers along their edges for engagement by said seals.

23. The platen press defined in claim 1 wherein said press platens are provided with thermal insulating elements along respective edges juxtaposed with said seals for engagement thereby.

24. The platen press defined in claim 23, further comprising a clamping device for securing each said insulating element to the respective press platen.

* * * * *